US006579004B1

(12) United States Patent
Kim

(10) Patent No.: US 6,579,004 B1
(45) Date of Patent: Jun. 17, 2003

(54) INTERNET CLOCK

(75) Inventor: Kwang-Sung Kim, Seoul (KR)

(73) Assignee: Romanson Watch Co., Ltd., Seoul (KR)

( * ) Notice: Subject to any disclaimer, the term of this patent is extended or adjusted under 35 U.S.C. 154(b) by 0 days.

(21) Appl. No.: 09/439,045

(22) Filed: Nov. 12, 1999

(30) Foreign Application Priority Data

Oct. 12, 1999 (KR) ..... 1999-43960

(51) Int. Cl.[7] ..... G04B 19/22; G04B 19/04; G04B 19/06

(52) U.S. Cl. ..... 368/295; 368/21; 368/80; 368/228; 368/27

(58) Field of Search ..... 368/21, 294, 295, 368/276, 300, 228, 232; 360/19, 221, 203, 27, 80

(56) References Cited

U.S. PATENT DOCUMENTS

| | | | | | |
|---|---|---|---|---|---|
| 4,175,378 | A | * | 11/1979 | Shelton | 368/221 |
| 4,185,452 | A | * | 1/1980 | Ikeda | 368/76 |
| 4,347,594 | A | * | 8/1982 | Tschanz | 368/21 |
| 4,420,264 | A | * | 12/1983 | Murata | 368/294 |
| 4,626,107 | A | * | 12/1986 | Nishikawa et al. | 368/276 |
| 4,634,287 | A | * | 1/1987 | Vuilleumier et al. | 368/27 |
| 4,815,053 | A | * | 3/1989 | Dal Busco | 368/294 |
| 4,847,819 | A | * | 7/1989 | Hong | 368/21 |
| 4,975,893 | A | * | 12/1990 | Dal Busco | 368/294 |
| 5,122,997 | A | * | 6/1992 | Schneider et al. | 368/294 |
| 5,161,129 | A | * | 11/1992 | Chen et al. | 368/19 |
| 5,319,617 | A | * | 6/1994 | Sonoda | 368/294 |
| 5,541,895 | A | * | 7/1996 | Nussbaum | 368/295 |
| 5,745,440 | A | * | 4/1998 | Chen | 368/21 |
| 5,822,279 | A | * | 10/1998 | Cuche et al. | 368/295 |
| 5,889,736 | A | * | 3/1999 | Fujita et al. | 368/203 |
| 5,982,710 | A | * | 11/1999 | Rawat et al. | 368/21 |

FOREIGN PATENT DOCUMENTS

| | | | | | |
|---|---|---|---|---|---|
| EP | 000573386 | A1 | * | 12/1993 | 368/295 |
| JP | 362148879 | A | * | 8/1987 | 368/295 |
| JP | 363134991 | A | * | 6/1988 | 368/295 |
| JP | 405087947 | A | * | 4/1993 | 368/295 |
| JP | 405087948 | A | * | 4/1993 | 368/295 |
| JP | 405157856 | A | * | 6/1993 | 368/295 |

OTHER PUBLICATIONS

Claude et al., Universal Wristwatch, CH000655221, abstract, Apr. 1986.*

Yamagata, Eichiyousei, Preventing Device for Rotation of Register Ring of Diver Watch, JP357111491, abstract, Jul. 1982.*

Ray et al., Universal Watch, CH000655221, abstract, Apr. 1986.*

Yamagata, Eichiyousei, Preventing Device for Rotation of Register Ring of Diver Watch, JP357111491, abstract, Jul. 1982.*

* cited by examiner

*Primary Examiner*—Vit Miska
*Assistant Examiner*—Jeanne-Marguerite Goodwin
(74) *Attorney, Agent, or Firm*—Alan Kamrath; Rider, Bennett, Egan & Arundel, LLP

(57) ABSTRACT

An internet watch in accordance with the present invention further comprises a beat hand 4 to indicate internet time and a beat dial 5 mounted on the circumferential outside of the watch having an hour hand 1, a minute hand 2, and a second hand 3, thereby the internet watch can indicate internet time in addition to Standard time on the basis of GMT. The beat dial 5 is marked with 1000 beats with a day being divided into 1000 equal parts in internet time. The best dial 5 is assembled to be rotatable so that the internet time can be adjusted when the user travels in a region where a different standard time is applied. The beat hand 4 which rotates once a day and the beat dial 5 on which 1000 beats are marked facilitate to get internet time easily without conversion to the standard time based on GMT, which is variable according to the longitude.

8 Claims, 6 Drawing Sheets

INTERNET CLOCK

SUMMARY OF THE INVENTION

The present invention relates to a new watch. More particularly, the present invention relates to a wrist watch which displays not only time for each region on the earth but recently coming internet time. This invention can be applied to a wall clock and a table clock as well as a wrist watch.

BACKGROUND OF THE INVENTION

In general a watch is used broadly as means of displaying time. Standard time, which is on the basis of GMT Greenwich mean time, is set according to the longitude of each region on the earth. Therefore, the watch is generally mounted with an hour hand, a minute hand, and a second hand as essential components for displaying time.

In accordance with the emergence of internet and communication using personal computers, a new concept of time which all over the world could share together was needed. We define a concept of time thereof as "internet time" for convenience sake.

Putting the internet time to practical use, it is very efficient for people in a different time zone to communicate with each other through the internet. For example, assume that a person A in Seoul wants to communicate with the other person B in New York through the internet. If they make an appointment on the basis of a certain local time, the other should converse the time to the local time which belongs to his time zone. For instance, 9:00 am in Seoul is converted to 7:00 pm of the previous day in New York. However, in this case, if they use the same time applied everywhere on the earth, inconvenience caused by time conversion will be lessened to a degree.

The concept of internet time was introduced from the above-mentioned ideas. In GMT, a day is divided into 24 hours, an hour into 60 minutes, and a minute into 60 seconds. Therefore, according to GMT, a day is equal to 1440 minutes or 86,400 seconds.

In the concept of internet time, a day is divided equally into 1000 parts for the exact time. The time unit is called "beat" in general, and the "beat" unit is used hereinafter for explanation. Accordingly, a day is composed of 1000 beats in internet time and a beat is equal to 86.4 seconds, which is 1 minute and 26.4 seconds. BMT (Biel Meridian Time) is set up as an initial standard time of internet time. The standard time of BMT is an hour later than that of GMT.

The internet watch in accordance with this invention enables the user to recognize internet time by adding a beat hand and by mounting a beat dial to indicate the beat time on the watch. It also enables the user to adjust internet time by rotating the beat dial when travelling in the region where the different standard time is applied.

OBJECTS OF THE INVENTION

An object of the present invention is to provide an internet watch indicating not only the time according to GMT but also an internet time. Another object of the present invention is to provide an internet watch for the wrist indicating not only the time according to GMT but also an internet time.

A further object of the present invention is to provide an internet watch which can adjust internet time by rotating a beat dial in the case when the user travels in the region where the different standard time is applied.

The above objects and other advantages of the present invention can be achieved by the ensuing disclosure and appended claims.

SUMMARY OF THE INVENTION

An internet watch to indicate internet time in addition to standard time on the basis of GMT further comprises a beat hand 4 to indicate internet time and a beat dial 5 mounted on the circumferential outside of the watch having an hour hand 1, a minute hand 2, and a second hand 3.

DETAILED DESCRIPTION OF THE INVENTION

The beat dial 5 marked to display 1000 beats is formed to be rotatable, so that the user adjusts internet time when travelling in the region where the different standard time is applied by rotation thereof.

The beat hand 4 rotates once a day, and the beat dial 5, on which 1000 beats are marked, facilitates to get internet time easily without conversion to the standard time based on GMT, which is variable according to the longitude.

Figure 1:
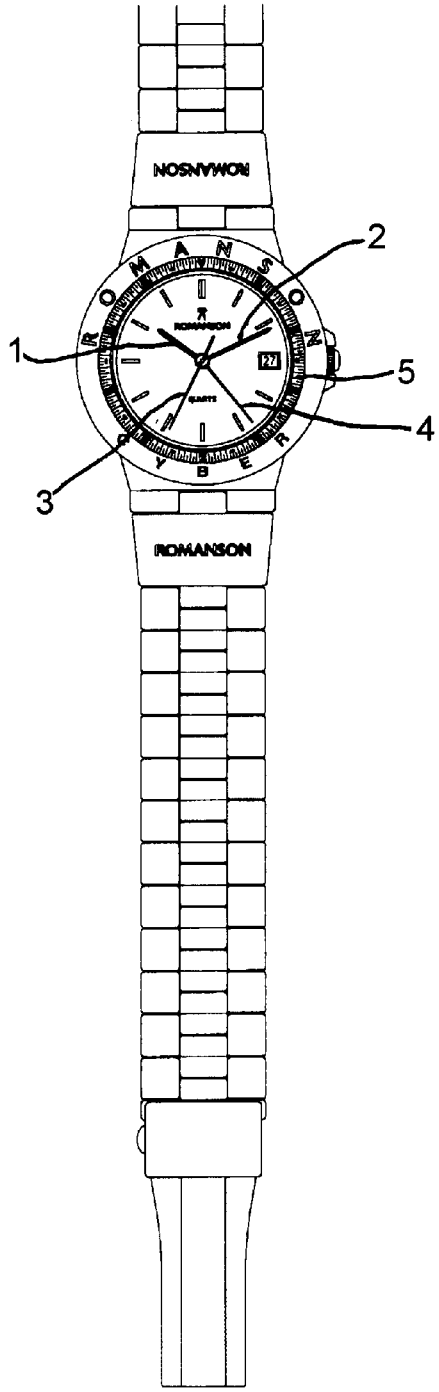
FIG. 1 is a schematic plan view of illustrating an internet watch in accordance with the present invention.
Figure 2:
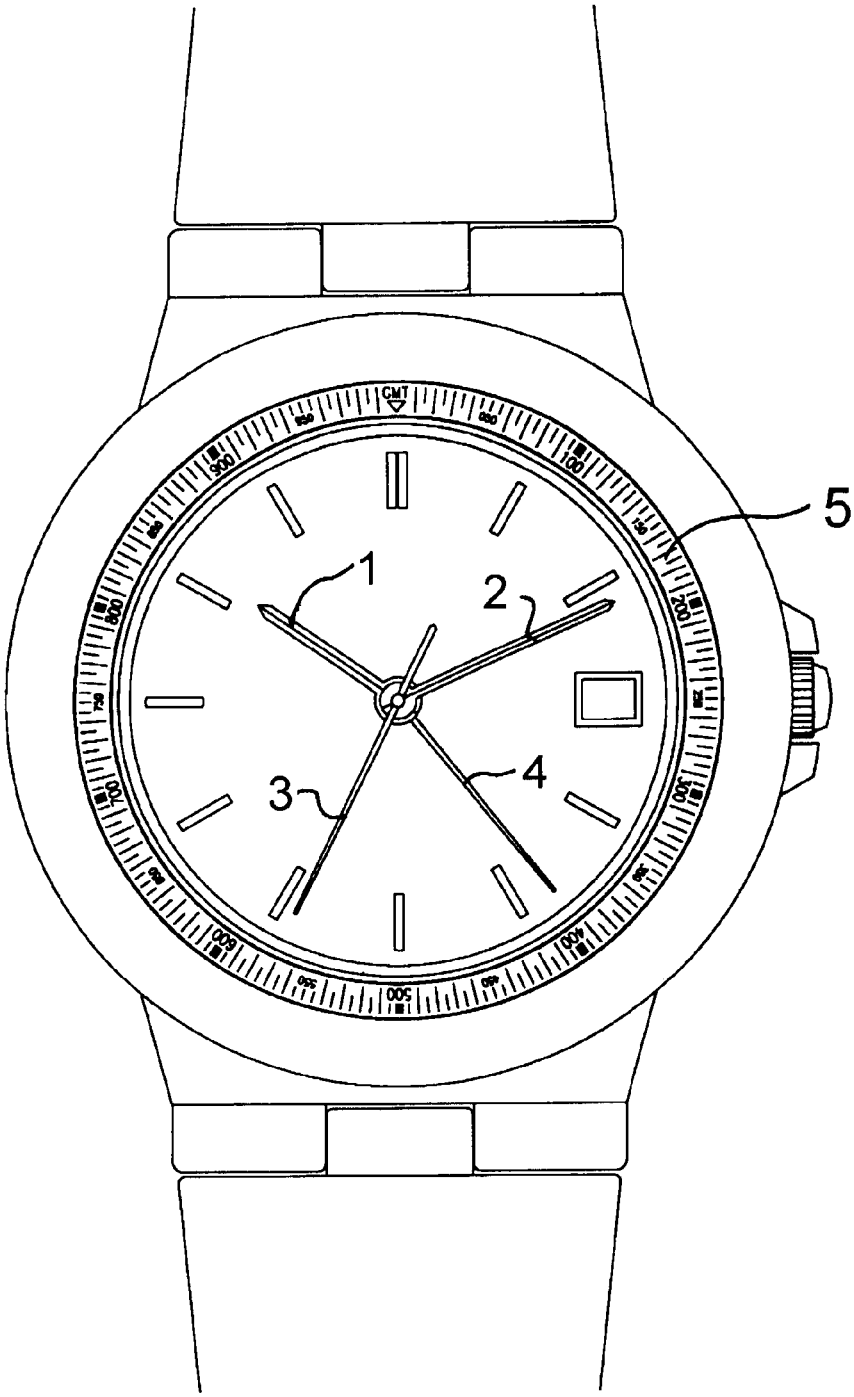
FIG. 2 is a enlarged plan view illustrating an internet watch in accordance with the present invention.

FIG. 1 is a schematic plan view illustrating an internet watch in accordance with the present invention, and FIG. 2 is a enlarged plane view illustrating an internet watch in accordance with the present invention. The internet watch of this invention comprises a beat hand 4 for indicating internet time in addition to an hour hand 1, an minute hand 2, a second hand 3, and a beat dial 5 mounted on the circumferential outside of the dial for indicating the standard time based on GMT.

Figure 3:
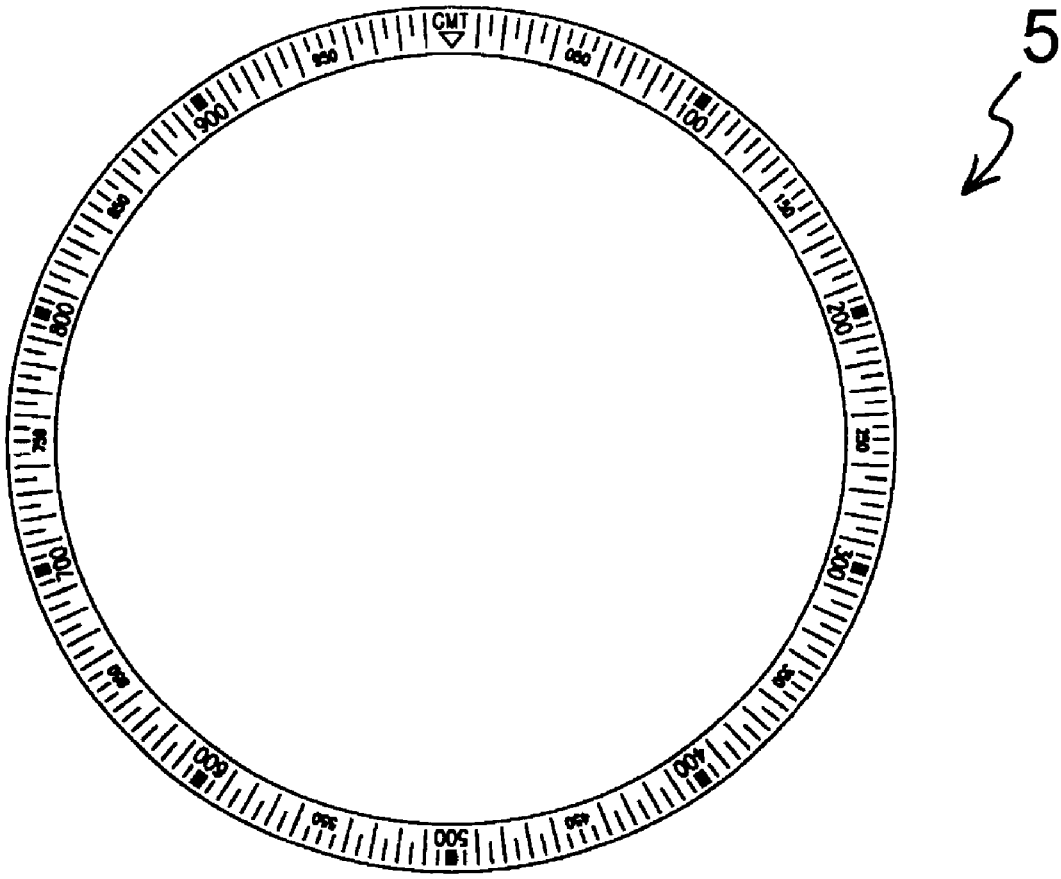
FIG. 3 is a plan view illustrating a beat dial indicating an internet time as a part of the internet watch.
Figure 4:
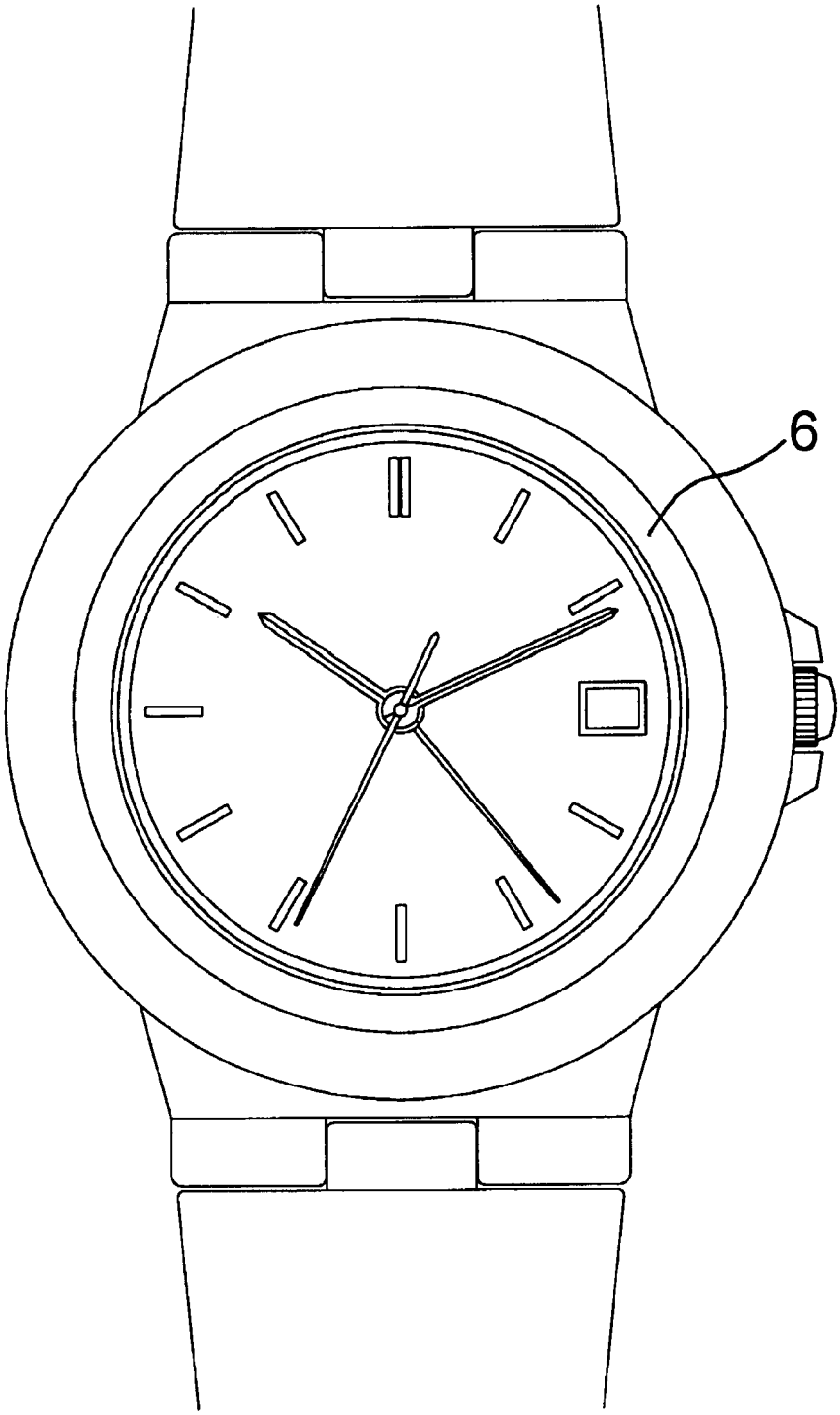
FIG. 4 is a plan view illustrating an internet watch wherein the internet dial separated therefrom.

FIG. 3 is a plan view illustrating a beat dial indicating internet time and FIG. 4 is a plan view illustrating an internet watch wherein the internet dial is separated therefrom. As illustrated in FIG. 3, the beat dial 5 is made in the form of a circular ring with a thin thickness and is assembled by being inserted into an inserting groove 6. The skills of inserting the beat dial 5 into the inserting groove 6 may be carried out by a person with an ordinary knowledge in the skill of watches.

The beat dial 5 is marked to display figures and graduations for indicating internet time. As a day is equal to 1000 beats on the basis of internet time, figures and graduations could be marked properly on the beat dial 5.

The beat dial 5 is assembled to be rotatable. Of course, the beat dial 5 also can be used in a fixed position. For example, if the present GMT is zero o'clock and the standard time in Seoul is 3:00 am, the hour hand 1 and the minute hand 2 will indicate 3:00 am. At the moment, the beat dial 5 is fixed for the beat hand 4 which can indicate beat dial 5.

However, in general, it is preferable for the hour hand 1 and the minute hand 2 to rotate together with the beat hand 4. For example, if the present time in Seoul is zero o'clock, the hour hand 1 and the minute hand 2 (including the second hand 3) will be located on the same position which indicate zero o'clock. At the moment, the beat hand 4 is adjusted to be in the same position. Then, the internet time should be set by rotating the beat dial 5. When the user travels in the region where the different standard time is applied, the beat dial 5 as well as the hour hand 1 and the minute hand 2 should be adjusted according to the standard time based on GMT for the region.

Figure 5:
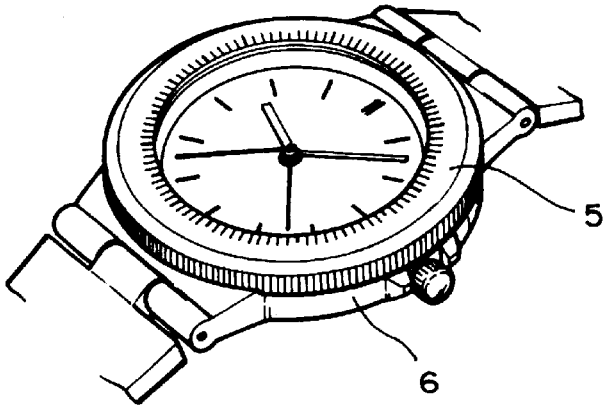
FIG. 5 is a schematic perspective view of the internet watch according to an embodiment of the present invention.
Figure 6:
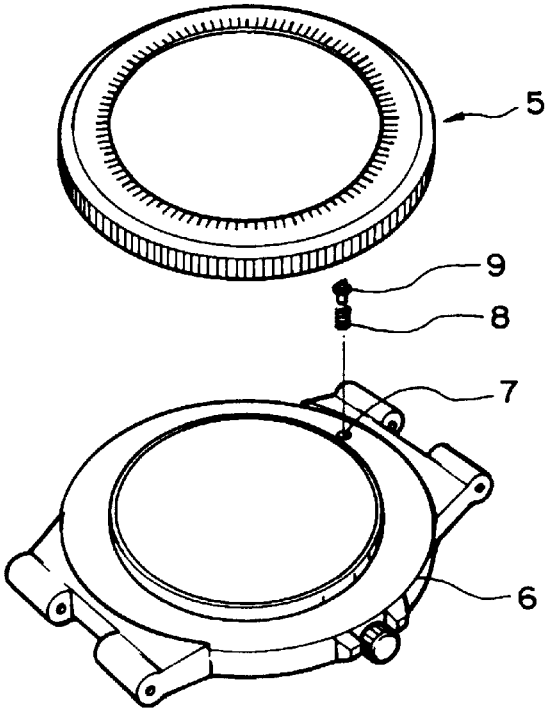
FIG. 6 a perspective view illustrating the disintegrated aspect of the internet watch according to FIG. 5.
Figure 7:
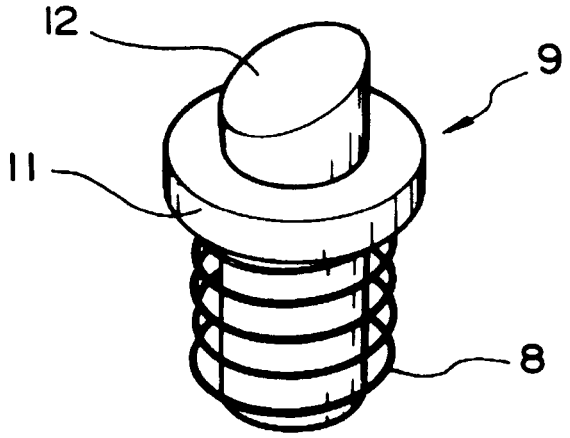
FIG. 7 is a perspective view illustrating combined structure of a spring with the fixing element in the internet watch according to an embodiment of the preset invention.
Figure 8:
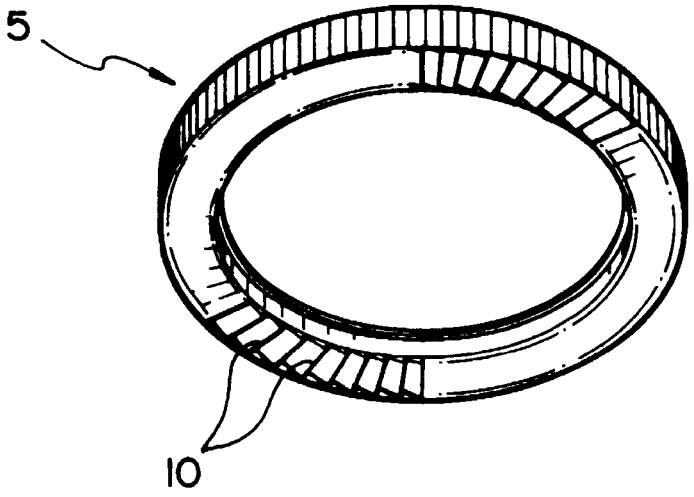
FIG. 8 is a perspective view illustrating a base of the beat dial of the internet watch according to an embodiment of the present invention.

FIG. 5 to FIG. 8 show the internet watch in accordance with an embodiment of this invention. FIG. 5 is a schematic perspective view of the internet watch according to an embodiment of the present invention, FIG. 6 is a perspective view illustrating the disintegrated aspect of the internet watch according to FIG. 5, FIG. 7 is a perspective view illustrating the combined structure of a spring 8 with the fixing element 9 in the internet watch according to an embodiment of the present invention, and FIG. 8 is a perspective view illustrating the base of the beat dial of the internet watch according to an embodiment of the present invention.

As shown in FIG. 6, bore 7 is formed on the certain position of the watch case where the beat dial 5 is assembled. A spring 8 is inserted into the bore 7 and a fixing element 9 is inserted into the spring 8. As shown in FIG. 7, the fixing element 9 is formed with a locking projection 11 by which the spring 8 gets stuck, and an inclined surface 12 is formed on the upper portion of the fixing element 9 to rotate the beat dial 5 in a uniform direction. The beat dial 5 is inserted into the inserting groove 6 to rotate in a uniform direction. As shown in FIG. 8, a projection 10 is formed on the base that the beat dial 5 is inserted into the inserting groove 6 to rotate in a uniform direction.

Although the beat dial of this invention has been described mainly as a wrist watch, it can be properly applied to a table clock.

The present invention can be easily carried out by an ordinary skilled person in the art. Many modifications and changes may be deemed to be within the scope of the present invention as defined in the following claims.

What is claimed is:

1. A watch comprising, in combination: first means for displaying standard time on a basis of a day being divided into 24 hours, an hour into 60 minutes, and a minute into 60 seconds, wherein the first means comprises, in combination: an hour hand and a minute hand, with the hour and minute bands being rotatable about an axis; and second means for displaying beat time on a basis of a day being divided into 1000 beats and simultaneously as the standard time is displayed by the first means, wherein the second means comprises, combination: a beat dial, and a beat hand to indicate beat time on the beat dial, with the beat hand being rotatable about an axis, wherein the beat dial is mounted circumferentially outside of the hour hand and the minute hand, wherein the beat dial is rotatable between adjustable, fixed positions to allow adjustment when a user travels in a region where a different standard time is applied.

2. The watch of claim 1 wherein the axes of the beat hand and of the hour and minute hands are coextensive.

3. The watch of claim 1 further comprising, in combination: a case, with the beat dial being rotatable relative to the case; a series of projections formed on the beat dial; and an inclined surface carried by the case and for engaging with the series of projections formed on the beat dial, with the inclined surface allowing rotation of the beat dial in a first direction and preventing rotation of the beat dial in a direction opposite to the first direction.

4. The watch of claim 3 further comprising, in combination: a fixing element including the inclined surface, with the case including a bore, with the beat dial positioned over the bore; and a spring received in the bore, with the fixing element being biased by the spring such that the inclined surface engages the beat dial.

5. The watch of claim 4 wherein the beat hand rotates once a day about the axis.

6. The watch of claim 1 further comprising, in combination: a case including a bore, with the beat dial being rotatable relative to the case and positionable over the bore; a series of projections formed on the beat dial; a spring received in the bore; and a fixing element biased by the spring to engage the beat dial and to engage with one of the series of the projections formed on the beat dial.

7. The watch of claim 1 wherein the beat hand rotates once a day about the axis.

8. The watch of claim 1 with the first means further comprising, in combination: a standard time dial for indicating standard time, with the standard time dial divided into twelve hours, with the beat dial being mounted circumferentially outside of the standard time dial.

* * * * *